US010623862B1

(12) United States Patent
Zheng et al.

(10) Patent No.: US 10,623,862 B1
(45) Date of Patent: Apr. 14, 2020

(54) SYSTEM AND METHOD UTILIZING HUMAN BODY AS TRANSMISSION MEDIUM FOR COMMUNICATION

(71) Applicant: BESTECHNIC (SHANGHAI) CO., LTD., Shanghai (CN)

(72) Inventors: Tao Zheng, Shanghai (CN); Fei Fang, Shanghai (CN); Lu Chai, Shanghai (CN)

(73) Assignee: BESTECHNIC (SHANGHAI) CO., LTD., Shanghai (CN)

( * ) Notice: Subject to any disclaimer, the term of this patent is extended or adjusted under 35 U.S.C. 154(b) by 0 days.

(21) Appl. No.: 16/260,071

(22) Filed: Jan. 28, 2019

(30) Foreign Application Priority Data

Sep. 29, 2018 (CN) ..... 2018 1 1147079

(51) Int. Cl.

| | |
|---|---|
| ***H04R 1/10*** | (2006.01) |
| ***H04R 5/033*** | (2006.01) |
| ***H04R 5/04*** | (2006.01) |
| ***H04R 3/12*** | (2006.01) |

(52) U.S. Cl.
CPC ..... *H04R 5/04* (2013.01); *H04R 3/12* (2013.01); *H04R 5/033* (2013.01); *H04R 1/1008* (2013.01); *H04R 2420/07* (2013.01)

(58) Field of Classification Search
CPC ... A61B 5/0478; A61B 5/6803; A61B 5/6814; A61B 5/0024; A61B 5/6815; H04B 13/005
USPC ..... 455/41.1; 381/74
See application file for complete search history.

(56) References Cited

U.S. PATENT DOCUMENTS

2006/0252371 A1* 11/2006 Yanagida ..... H04B 13/005 455/41.1
2013/0316642 A1* 11/2013 Newham ..... H04W 52/0206 455/11.1
2016/0100239 A1* 4/2016 Shin ..... H04B 13/005 381/74
2018/0183131 A1* 6/2018 Chen ..... H01Q 1/22

* cited by examiner

*Primary Examiner* — George C Monikang
(74) *Attorney, Agent, or Firm* — Bayes PLLC

(57) ABSTRACT

Embodiments of a system utilizing a human body for communication, a headset that uses a human body as a transmission medium, and a headset stereo playback method are disclosed. In an example, a system utilizing a human body for communication includes a processing chip, a signal emitting module and a signal receiving module connected with the processing chip, a signal receiving antenna connected to the signal receiving module, and a signal emitting electrode connected to the signal emitting module. The signal emitting electrode is separated from the signal receiving antenna. The signal emitting electrode and the signal receiving antenna are coupled to the human body for emitting a signal to the human body and receiving a signal from the human body.

20 Claims, 3 Drawing Sheets

SYSTEM AND METHOD UTILIZING HUMAN BODY AS TRANSMISSION MEDIUM FOR COMMUNICATION

CROSS-REFERENCE TO RELATED APPLICATIONS

This application claims the benefit of priority to Chinese Patent Application No. 201811147079.5, filed on Sep. 29, 2018, which is incorporated herein by reference in its entirety.

BACKGROUND

Embodiments of the present disclosure relate to the field of communication systems and headset technology, and specifically related to systems utilizing a human body for communication, headsets using a human body as a transmission medium and methods thereof.

With the continuous development of society, people's demand for wearable electronic products (such as headphones, watches, hand rings, etc.) is increasing. Comparing with the traditional way of wired transmission signal, wireless transmission greatly improves the convenience and comfort of wearable electronic products. At present, for a real wireless headset with stereo, audio transmission between left and right ears is achieved mainly through a pair of Bluetooth headphones or through NFMI (near field magnetic induction technology) forwarding.

The 2.4G frequency band used by Bluetooth has large interference. The electromagnetic waves of this frequency band can be easily absorbed by a human body, making it difficult to achieve stable transmission. While NFMI uses inductance and capacitance resonance mode to achieve high impedance, the bandwidth of which is narrower (a typical central frequency being 10-30 MHz, 3 dB bandwidth being 0.1-3 MHz). Therefore, the transfer rate between the ears when using these two methods is low, and high-quality wireless stereo headphones cannot be achieved. In addition, headphones using NFMI forwarding need an additional integrated inductor coil to achieve magnetic coupling, usually a winding ferrite core inductor coil, having a typical size of $6\times3\times2$ mm$^3$, and a relatively large antenna size; thus, the design of the headphones is greatly limited, not conducive to the miniaturization of real wireless headphones.

In order to avoid human magnetic field interference to the signal transmission between the left and right Bluetooth earphones, improve the reliability of transmission, the existing technology integrates human electrodes in the Bluetooth headset, with the help of the human body for communication.

However, in order to achieve human body communication, the human electrode is usually used as an antenna. The output signal of the transmitter is loaded to the human body through an electrode in contact with the human body, the signal is transmitted through the human body, and the receiver of another communication device receives the signal through an electrode in contact with the human body. Since the high frequency noise on the human body can easily be coupled into the receiver by capacitance coupling, which affects the signal-to-noise ratio of input signals of the receiver. As far as the current technology is concerned, in order to increase the signal-to-noise ratio of the input signals of the receiver, the only solution is to increase the area of the human electrode, but this will inevitably cause the overall shape of the headset to be larger, which is not conducive to the miniaturization of headphones.

SUMMARY

Embodiments of systems utilizing a human body for communication, headsets that use a human body as a transmission medium, and headset stereo playback methods are disclosed herein.

In one example, a system utilizing a human body for communication includes a processing chip, a signal emitting module and a signal receiving module connected with the processing chip, a signal receiving antenna connected to the signal receiving module, and a signal emitting electrode separated from the signal receiving antenna. The signal emitting electrode is connected to the signal emitting module. The signal emitting electrode and the signal receiving antenna are coupled to the human body for emitting a signal to the human body and receiving a signal from the human body.

In another example, a headset that uses a human body as a transmission medium includes a left headphone and a right headphone. One of the left headphone and the right headphone establishes a connection with an electronic device for receiving audio signals from the electronic device. The left headphone and the right headphone communicate with each other through the human body.

In a different example, a headset stereo playback method is disclosed. A connection between a primary headphone and an electronic device is established. The primary headphone receives a digital audio signal from the electronic device through the connection. The primary headphone demodulates the received digital audio signal to obtain a raw data. The primary headphone generates a first channel data and a second channel data from the raw data. The primary headphone plays back the first channel data after a delay and forwards the second channel data to a secondary headphone through a human body. The secondary headphone plays back the second channel data.

BRIEF DESCRIPTION OF THE DRAWINGS

The accompanying drawings, which are incorporated herein and form a part of the specification, illustrate embodiments of the present disclosure and, together with the description, further serve to explain the principles of the present disclosure and to enable a person skilled in the pertinent art to make and use the present disclosure.

Figure 1:
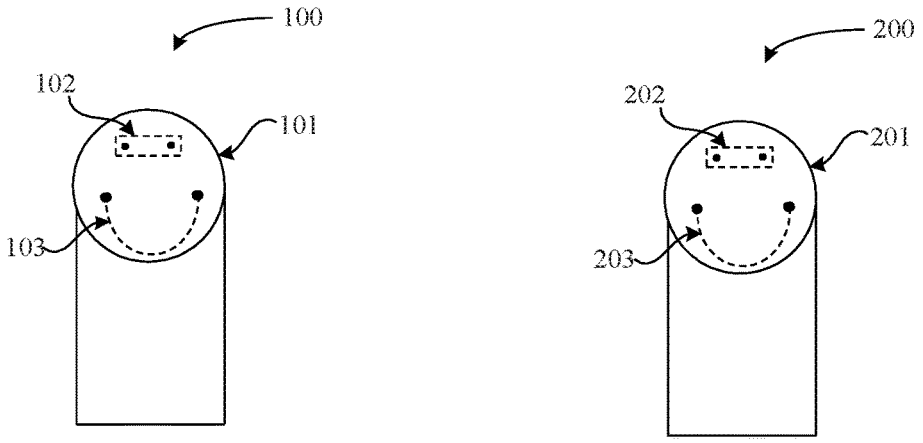
FIG. 1 is a schematic diagram illustrating the structure of the left Bluetooth headphone and the right Bluetooth headphone, according to an embodiment of the present disclosure.

Embodiments of the present disclosure will be described with reference to the accompanying drawings.

DETAILED DESCRIPTION

Although specific configurations and arrangements are discussed, it should be understood that this is done for illustrative purposes only. A person skilled in the pertinent art will recognize that other configurations and arrangements can be used without departing from the spirit and scope of the present disclosure. It will be apparent to a person skilled in the pertinent art that the present disclosure can also be employed in a variety of other applications.

It is noted that references in the specification to "one embodiment," "an embodiment," "an example embodiment," "some embodiments," etc., indicate that the embodiment described may include a particular feature, structure, or characteristic, but every embodiment may not necessarily include the particular feature, structure, or characteristic. Moreover, such phrases do not necessarily refer to the same embodiment. Further, when a particular feature, structure or characteristic is described in connection with an embodiment, it would be within the knowledge of a person skilled in the pertinent art to effect such feature, structure or characteristic in connection with other embodiments whether or not explicitly described.

In general, terminology may be understood at least in part from usage in context. For example, the term "one or more" as used herein, depending at least in part upon context, may be used to describe any feature, structure, or characteristic in a singular sense or may be used to describe combinations of features, structures or characteristics in a plural sense. Similarly, terms, such as "a," "an," or "the," again, may be understood to convey a singular usage or to convey a plural usage, depending at least in part upon context. In addition, the term "based on" may be understood as not necessarily intended to convey an exclusive set of factors and may, instead, allow for existence of additional factors not necessarily expressly described, again, depending at least in part on context.

Various embodiments in accordance with the present disclosure provide a system utilizing a human body for communication, which includes a processing chip, as well as a signal emitting module and a signal receiving module connected to the processing chip. The system also includes a signal receiving antenna and a signal emitting electrode separated from the signal receiving antenna. The signal receiving antenna is connected to the signal receiving module, and the signal emitting electrode is connected to the signal emitting module. The signal receiving antenna is connected to the signal receiving module through a receiving matching circuit, and the signal emitting electrode is connected to the signal emitting module through an emission matching circuit. The system utilizing a human body for communication provided by the present disclosure can be used in different wearable devices, including but not limited to wearable devices that come into contact with the human body, such as headphones and hand rings.

FIG. 1 illustrates a schematic diagram showing the structure of a left Bluetooth headphone 100 and a right Bluetooth headphone 200, according to an embodiment of the present disclosure. Left Bluetooth headphone 100 and right Bluetooth headphone 200 may be a pair of loudspeakers that can be worn on or around the head over a user's ears. Left Bluetooth headphone 100 and right Bluetooth headphone 200 may be any electroacoustic transducers that convert an electrical signal (e.g., representing the audio information provided by an audio source) to a corresponding sound. In some embodiments, each one of left Bluetooth headphone 100 and right Bluetooth headphone 200 may be an earbud (also known as earpiece) that can plug into the user's ear canal. In some embodiments, left Bluetooth headphone 100 and right Bluetooth headphone 200 may be true wireless stereo (TWS) headphones, which are individual units that are not physically held by a band over the head and/or electrically connected by a cord. Left Bluetooth headphone 100 and/or right Bluetooth headphone 200 may be combined with a microphone to form a headset according to some embodiments.

A Bluetooth headphone that utilizes a human body for communication can include a headphone housing, a processing chip placed in the headphone housing, and a signal emitting module and a signal receiving module connected to the processing chip, in which the headphone housing has a signal receiving antenna, as well as a signal emitting electrode integrated on the headphone housing and separated from the signal receiving antenna. The signal receiving antenna of the present disclosure can include, but is not limited to, a linear antenna, a coil, or a surround curved antenna.

In this embodiment, the left Bluetooth headphone 100 and the right Bluetooth headphone 200 have the same structure. The left Bluetooth headphone 100 includes a left headphone housing 101. When used by a user, the left headphone housing 101 is inserted into the left ear canal of a human. A processing chip as well as a signal emitting module and a signal receiving module connected with the processing chip are arranged within the left headphone housing 101. It should be understood that the left Bluetooth headphone housing also has a Bluetooth module as well as a circuit module required for a Bluetooth headphone, which should be known to a person skilled in the art.

The left headphone housing 101 has a first signal receiving antenna 103, and a first signal emitting electrode 102, which is integrated into the left headphone housing 101 and separated from the first signal receiving antenna 103.

Similarly, the right Bluetooth headphone 200 includes a right headphone housing 201. When used by a user, the right headphone housing 201 is inserted into the right ear canal of a human. A processing chip as well as a signal emitting module and a signal receiving module connected with the processing chip are arranged within the right headphone housing 201. It should be understood that the right Bluetooth headphone housing also has a Bluetooth module as well as a circuit module required for a Bluetooth headphone, which should be known to a person skilled in the art.

The right headphone housing 201 has a second signal receiving antenna 203, and a second signal emitting electrode 202, which is integrated into the right headphone housing 201 and separated from the second signal receiving antenna 203.

According to an embodiment of the present disclosure, the signal emitting electrode is integrated inside the headphone housing, in contact with the human ear canal through a dielectric layer, or the signal emitting electrode is integrated outside the headphone housing, in direct contact with the human ear canal. The signal emitting electrode has a flaky structure, made of metal materials, such as copper, aluminum, or alloys. The signal emitting electrode is integrated with the inside of the headphone housing or the outside of the headphone housing by laser engraving (LDS) or direct pasting. Take the left Bluetooth headphone 100 as an example, in some embodiments, the first signal emitting electrode 102 is integrated with the inside of the left headphone housing 101. When a user inserts the left headphone housing 101 inside the ear canal, the first signal emitting electrode 102 and the human body contact through a dielectric layer (such as the headphone housing).

In other embodiments, the first signal emitting electrode 102 is integrated with the outside of the left headphone housing 101. When a user inserts the left headphone housing 101 inside the ear canal, the first signal emitting electrode 102 and the human body contact directly.

In further other embodiments, the first signal emitting electrode 102 is integrated with the outside of the left headphone housing 101. When a user inserts the left headphone housing 101 inside the ear canal, the first signal emitting electrode 102 and the human body contact through a dielectric layer (such as the disposed dielectric layer).

In still other embodiments, the signal emitting electrode is directly engraved on the printed circuit board (PCB), and the signal emitting electrode is placed inside the headphone housing. In a still further embodiment, the first signal emitting electrode 102 and the headphone housing are spaced by a dielectric layer, and the headphone housing and the human body are spaced by a dielectric layer.

According to an embodiment of the present disclosure, the signal receiving antenna is a wire, more preferably, the signal receiving antenna is a flat printed circuit (FPC) metal wire, the length of which is 0.5 cm to 5 cm (e.g., 0.5 cm, 0.6 cm, 0.7 cm, 0.8 cm, 0.9 cm, 1 cm, 1.5 cm, 2 cm, 2.5 cm, 3 cm, 3.5 cm, 4 cm, 5 cm, any range bounded by the lower end by any of these values, or in any range defined by any two of these values). The signal receiving antenna is fixed to the inside of the headphone housing by means of laser engraving and processing.

Take the left Bluetooth headphone 100 as an example, in some embodiments, the first signal receiving antenna 103 is integrated directly through laser engraving processing (LDS) into the left headphone housing 101. In other embodiments, the first signal receiving antenna 103 chooses to use an FPC wire.

Figure 2:
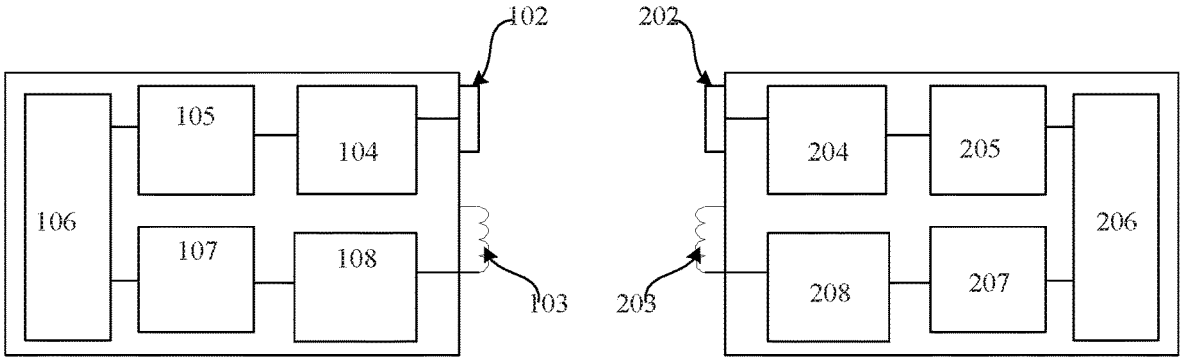
FIG. 2 is a module block diagram illustrating the structure of the left Bluetooth headphone and the right Bluetooth headphone, according to an embodiment of the present disclosure.

As shown in FIG. 2, which is a module block diagram illustrating the structure of the left Bluetooth headphone and the right Bluetooth headphone. In the left Bluetooth headphone 100, the first signal receiving antenna 103 is connected to the first signal receiving module 107 through the first receiving matching circuit 108. The first signal emitting electrode 102 is connected to the first signal emitting module 105 through the first emission matching circuit 104. The first signal emitting module 105 and the first signal receiving module 107 are respectively connected to the processing chip 106.

In the right Bluetooth headphone 200, the second signal receiving antenna 203 is connected to the second signal receiving module 207 through the second receiving matching circuit 208. The second signal emitting electrode 202 is connected to the second signal emitting module 205 through the second emission matching circuit 204. The second signal emitting module 205 and the second signal receiving module 207 are respectively connected to the processing chip 206.

Figure 3:
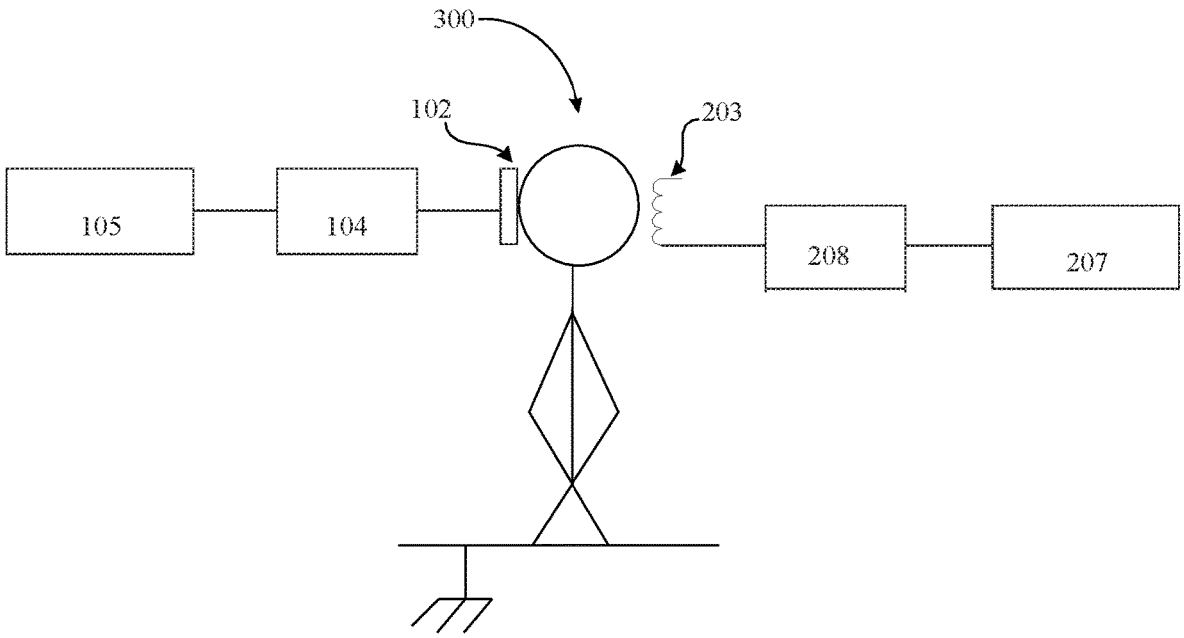
FIG. 3 is a schematic diagram illustrating the use of human body communication by the Bluetooth headset, according to an embodiment of the present disclosure.

As shown in FIG. 3, which is a schematic diagram illustrating the use of human body communication by the Bluetooth headset, the user's human body 300 is wearing the left Bluetooth headphone 100 and the right Bluetooth headphone 200. The left Bluetooth headphone 100 or right Bluetooth headphone 200 establishes a Bluetooth connection with a smart device (such as a mobile phone). The left Bluetooth headphone 100 and the right Bluetooth headphone 200 communicate with the help of the human body.

In the embodiment, the illustration is based on the example that the left Bluetooth headphone 100 sends a signal and the right Bluetooth headphone 200 receives the signal. The same process will apply to the embodiment in which the right Bluetooth headphone 200 sends the signal and the left Bluetooth headphone 100 receives the signal and will not be repeated.

The first signal emitting module 105 of the left Bluetooth headphone 100 sends a signal. The first emission matching circuit 104 of the left Bluetooth headphone 100 sends the signal to the first signal emitting electrode 102. The first signal emitting electrode 102 couples the signal to the user's human body 300. The near field energy of human body radiation is received by the second signal receiving antenna 203 through coupling. This avoids the problem of direct coupling through capacitance, which causes the human body noise to be coupled into the receiver, and increases the signal-to-noise ratio of the input signal of the receiver.

It is understood that the communication between the left Bluetooth headphone 100 and the right Bluetooth headphone 200 can be any suitable communication types, such as Bluetooth, WiFi, and NFMI communications. Bluetooth is a wireless technology standard for exchanging data over short distances, and the Bluetooth protocol is one example of short-range wireless communication protocols. WiFi is a wireless technology for wireless local area networking based on the IEEE 802.11 standards, and the WiFi protocol (also known as the 802.11 protocol) is another example of short-range wireless communication protocols. NFMI communication is a short-range wireless communication by coupling a tight, low-power, non-propagating magnetic field between devices. NFMI communication can contain transmission energy within the localized magnetic field, which does not radiate into free space. In some embodiments, the carrier wave frequency for NFMI communication is between about 5 MHz and about 50 MHz (e.g., between 5 MHz and 50 MHz), such as between 5 MHz and 40 MHz, between 5 MHz and 30 MHz, between 5 MHz and 20 MHz, between 5 MHz and 10 MHz, between 15 MHz and 50 MHz, between 25 MHz and 50 MHz, between 35 MHz and 50 MHz, and between 45 MHz and 50 MHz. In some embodiments, the carrier wave frequency is about 10 MHz (e.g., 10 MHz) or about 13.56 MHz (e.g., 13.56 MHz).

It is also understood that the data communicated between left Bluetooth headphone 100 and the right Bluetooth headphone 200 may be raw data or compressed data. The raw data may be compressed by any suitable compression methods to reduce the size, such as MPEG Audio Layer III (MP3), Windows Media Audio (WMA), Advanced Audio Coding (AAC), Real Audio (RA), Free Lossless Audio Codec (FLAC), Linear Predictive Coding (LPC), etc.

It is further understood that as the left Bluetooth headphone 100 and the right Bluetooth headphone 200 have the same structures, their roles as primary headphone and secondary headphone can be fixed or switched. In some embodiments, the roles of left Bluetooth headphone 100 and the right Bluetooth headphone 200 can be switched depending on their relative signal qualities and/or power levels.

Since the quality of the input signal of the receiver is improved, the Bluetooth headphone that utilizes human body for communication according to the present disclosure can further reduce the size of the emitting electrode, improve the integration of the antenna, and reduce the area of the headphone housing taken up by the emitting electrode, thus reducing the size of the Bluetooth headset as a whole.

Figure 4:
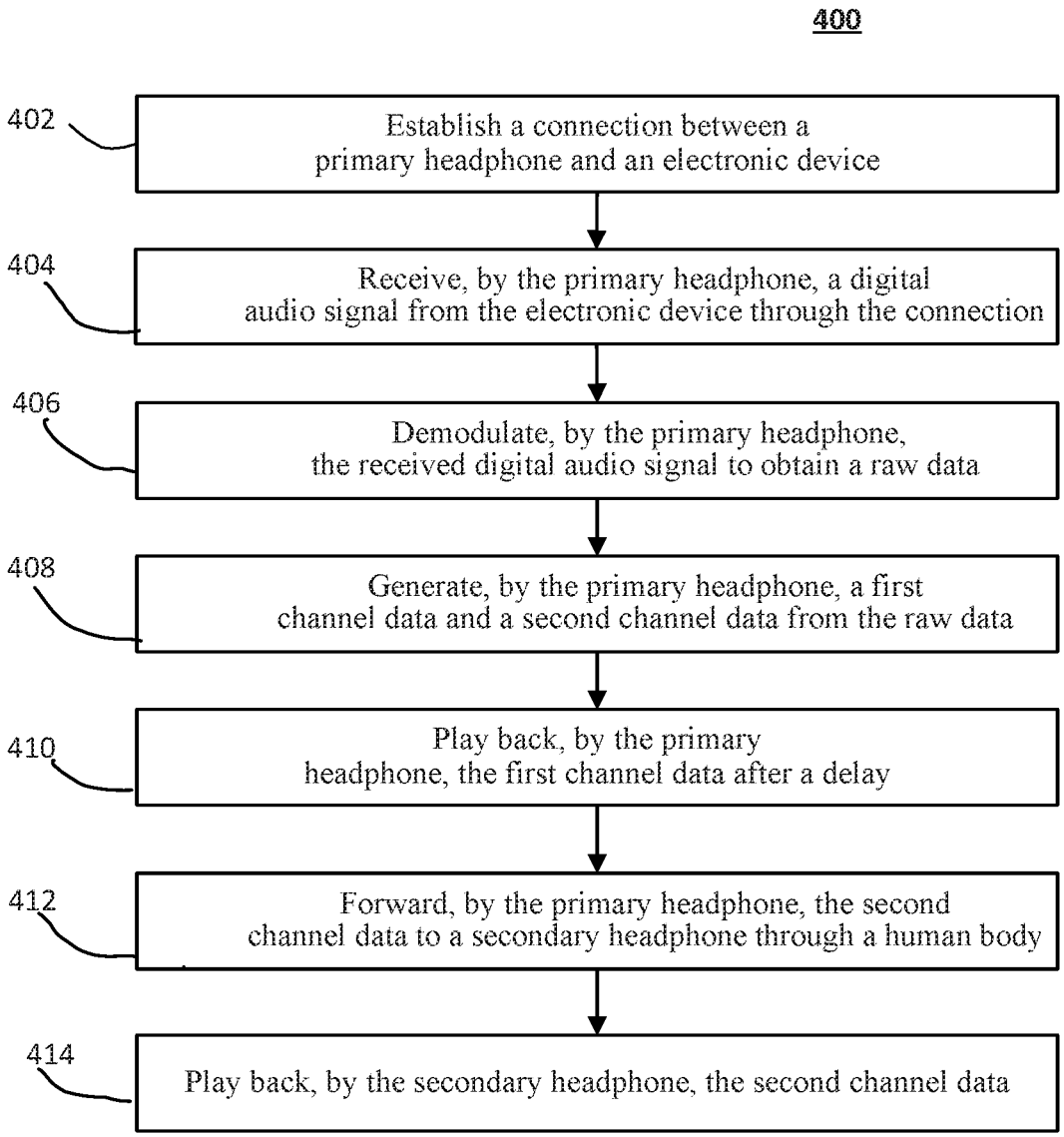
FIG. 4 illustrates a flow chart of an exemplary headset stereo playback process, according to an embodiment of the present disclosure.

FIG. 4 illustrates a flowchart 400 of an exemplary headset stereo playback process using the headset as described above. It is to be appreciated that not all steps may be needed to perform the disclosure provided herein. Further, some of the steps may be performed simultaneously, or in a different order than shown in FIG. 4, as will be understood by a person of ordinary skill in the art.

At step 402, a connection between a primary headphone and an electronic device is established. At step 404, the primary headphone receives a digital audio signal from the electronic device through the connection. At step 406, the primary headphone demodulates the received digital audio signal to obtain a raw data. At step 408, the primary headphone generates a first channel data and a second channel data from the raw data. The primary headphone plays back the first channel data after a delay at step 410, and forwards the second channel data to a secondary headphone through a human body at step 412. At step 414, the secondary headphone plays back the second channel data.

According to one aspect of the present disclosure, a system utilizing a human body for communication includes a processing chip, a signal emitting module and a signal receiving module connected with the processing chip, a signal receiving antenna connected to the signal receiving module, and a signal emitting electrode separated from the signal receiving antenna. The signal emitting electrode is connected to the signal emitting module. The signal emitting electrode and the signal receiving antenna are coupled to the human body for emitting a signal to the human body and receiving a signal from the human body.

In some embodiments, the system further includes a receiving matching circuit and an emission matching circuit. The signal receiving antenna is connected to the signal receiving module through the receiving matching circuit, and the signal emitting electrode is connected to the signal emitting module through the emission matching circuit, according to some embodiments.

In some embodiments, the system is a wearable electronic device utilizing the human body as a transmission medium.

According to another one aspect of the present disclosure, a headset that uses a human body as a transmission medium includes a left headphone and a right headphone. One of the left headphone and the right headphone establishes a connection with an electronic device for receiving audio signals from the electronic device. The left headphone and the right headphone communicate with each other through the human body.

In some embodiments, one of the left headphone and the right headphone is set as the primary headphone that receives the audio signals from the electronic device and the other one of the left headphone and the right headphone is set as the secondary headphone that receives audio signals from the primary headphone. In some embodiments, the primary headphone establishes the connection with the electronic device through a short-range wireless communication protocol.

In some embodiments, the relationship between the primary headphone and the secondary headphone is fixed. In some embodiments, the relationship between the primary headphone and the secondary headphone is switchable.

In some embodiments, each of the left headphone and the right headphone includes a headphone housing, a processing chip placed in the headphone housing. a signal emitting module and a signal receiving module connected with the processing chip, a signal receiving antenna in the headphone housing, and a signal emitting electrode in the headphone housing and separated from the signal receiving antenna. The signal emitting electrode and the signal receiving antenna are coupled to the human body for emitting audio signals to the human body and receiving audio signal from the human body.

In some embodiments, each of the left headphone and the right headphone further includes a receiving matching circuit and an emission matching circuit. The signal receiving antenna is connected to the signal receiving module through the receiving matching circuit, and the signal emitting electrode is connected to the signal emitting module through the emission matching circuit, according to some embodiments.

In some embodiments, the signal emitting electrode is integrated into an inside of the headphone housing and is in contact with a human ear canal through a dielectric layer.

In some embodiments, the signal emitting electrode is integrated into an outside of the headphone housing and is in contact with a human ear canal directly.

In some embodiments, signal emitting electrode has a flake structure and is integrated into an inside or an outside of the headphone housing by means of laser engraving or direct pasting.

In some embodiments, the signal emitting electrode is made of a metal material.

In some embodiments, wherein the signal receiving antenna is a metal wire with a length of 0.5 cm to 5 cm.

In some embodiments, the signal receiving antenna is a flat printed circuit metal wire.

According to still another one aspect of the present disclosure, a headset stereo playback method is disclosed. A connection between a primary headphone and an electronic device is established. The primary headphone receives a digital audio signal from the electronic device through the connection. The primary headphone demodulates the received digital audio signal to obtain a raw data. The primary headphone generates a first channel data and a second channel data from the raw data. The primary headphone plays back the first channel data after a delay and forwards the second channel data to a secondary headphone through a human body. The secondary headphone plays back the second channel data.

In some embodiments, the second channel data is modulated to a frequency acceptable for human body transmission before forwarding the second channel data to the secondary headphone through the human body.

In some embodiments, the received second channel data is demodulated by the secondary headphone before playing back.

In some embodiments, the second channel data is forwarded to the secondary headphone through the human body without coding.

The foregoing description of the specific embodiments will so reveal the general nature of the present disclosure that others can, by applying knowledge within the skill of the art, readily modify and/or adapt for various applications such specific embodiments, without undue experimentation, without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

Embodiments of the present disclosure have been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The Summary and Abstract sections may set forth one or more but not all exemplary embodiments of the present disclosure as contemplated by the inventor(s), and thus, are not intended to limit the present disclosure and the appended claims in any way.

The breadth and scope of the present disclosure should not be limited by any of the above-described exemplary embodiments, but should be defined only in accordance with the following claims and their equivalents.

What is claimed is:

1. A system utilizing a human body for communication, comprising:

a housing;

a processing chip in the housing;

a signal emitting module and a signal receiving module connected with the processing chip in the housing;

a signal receiving antenna connected to the signal receiving module; and a signal emitting electrode in the housing and separated from the signal receiving antenna, the signal emitting electrode being connected to the signal emitting module, and the signal emitting electrode having a flake structure and being integrated into an inside or an outside of the housing, wherein the signal emitting electrode and the signal receiving antenna are coupled to the human body for emitting a signal to the human body and receiving a signal from the human body.

2. The system of claim 1, further comprising:

a receiving matching circuit, the signal receiving antenna being connected to the signal receiving module through the receiving matching circuit; and an emission matching circuit, the signal emitting electrode being connected to the signal emitting module through the emission matching circuit.

3. The system of claim 1, wherein the system is a wearable electronic device utilizing the human body as a transmission medium.

4. A headset that uses a human body as a transmission medium, comprising:

a left headphone; and a right headphone, wherein one of the left headphone and the right headphone establishes a connection with an electronic device for receiving audio signals from the electronic device;

wherein the left headphone and the right headphone communicate with each other through the human body; and wherein each of the left headphone and the right headphone comprises:

a headphone housing; and a signal emitting electrode in the headphone housing, wherein the signal emitting electrode has a flake structure and is integrated into an inside or an outside of the headphone housing.

5. The headset of claim 4, wherein:

one of the left headphone and the right headphone is set as the primary headphone that receives the audio signals from the electronic device and the other one of the left headphone and the right headphone is set as the secondary headphone that receives audio signals from the primary headphone; and the primary headphone establishes the connection with the electronic device through a short-range wireless communication protocol.

6. The headset of claim 5, wherein the relationship between the primary headphone and the secondary headphone is fixed.

7. The headset of claim 5, wherein the relationship between the primary headphone and the secondary headphone is switchable.

8. The headset of claim 4, wherein each of the left headphone and the right headphone further comprises:

a processing chip placed in the headphone housing;

a signal emitting module and a signal receiving module connected with the processing chip; and a signal receiving antenna in the headphone housing, wherein the signal emitting electrode and the signal receiving antenna are coupled to the human body for emitting audio signals to the human body and receiving audio signal from the human body.

9. The headset of claim 8, wherein each of the left headphone and the right headphone further comprises:

a receiving matching circuit, the signal receiving antenna being connected to the signal receiving module through the receiving matching circuit; and an emission matching circuit, the signal emitting electrode being connected to the signal emitting module through the emission matching circuit.

10. The headset of claim 8, wherein the signal emitting electrode is integrated into an inside of the headphone housing and is in contact with a human ear canal through a dielectric layer.

11. The headset of claim 8, wherein the signal emitting electrode is integrated into an outside of the headphone housing and is in contact with a human ear canal directly.

12. The headset of claim 8, wherein the signal emitting electrode is integrated into the inside or the outside of the headphone housing by means of laser engraving or direct pasting.

13. The headset of claim 8, wherein the signal emitting electrode is made of a metal material.

14. The headset of claim 8, wherein the signal receiving antenna is a metal wire with a length of 0.5 cm to 5 cm.

15. The headset of claim 8, wherein the signal receiving antenna is fixed inside the headphone housing by means of laser engraving processing.

16. The headset of claim 14, wherein the signal receiving antenna is a flat printed circuit metal wire.

17. A headset stereo playback method, comprising:

providing a primary headphone and a secondary headphone, wherein each of the primary headphone and the secondary headphone comprises:

a headphone housing; and a signal emitting electrode in the headphone housing, wherein the signal emitting electrode has a flake structure and is integrated into an inside or an outside of the headphone housing;

establishing a connection between a primary headphone and an electronic device;

receiving, by the primary headphone, a digital audio signal from the electronic device through the connection;

demodulating, by the primary headphone, the received digital audio signal to obtain a raw data;

generating, by the primary headphone, a first channel data and a second channel data from the raw data;

playing back, by the primary headphone, the first channel data after a delay;

forwarding, by the primary headphone, the second channel data to a secondary headphone through a human body; and playing back, by the secondary headphone, the second channel data.

18. The method of claim 17, further comprising:

modulating the second channel data to a frequency acceptable for human body transmission before forwarding the second channel data to the secondary headphone through the human body.

19. The method of claim 18, further comprising:

demodulating, by the secondary headphone, the received second channel data before playing back.

20. The method of claim 17, wherein the second channel data is forwarded to the secondary headphone through the human body without coding.

* * * * *